United States Patent [19]

Ishler

[11] Patent Number: 4,578,908

[45] Date of Patent: Apr. 1, 1986

[54] FABRIC ROOF STRUCTURE

[75] Inventor: Michael W. Ishler, Toledo, Ohio

[73] Assignee: Owens-Corning Fiberglas Corporation, Toledo, Ohio

[21] Appl. No.: 602,031

[22] Filed: Apr. 19, 1984

[51] Int. Cl.[4] ..... E04B 1/347

[52] U.S. Cl. ..... 52/63; 52/83; 135/98; 135/DIG. 8

[58] Field of Search ..... 52/63, 82, 80, 83, 23, 52/223 R; 135/DIG. 8, 98, 99

[56] References Cited

U.S. PATENT DOCUMENTS

| | | | |
|---|---|---|---|
| 1,219,847 | 3/1917 | Nettenstrom | 135/98 |
| 1,258,410 | 3/1918 | Hill | 52/82 |
| 2,622,546 | 12/1952 | Kramrisch | 135/DIG. 8 |
| 2,670,818 | 3/1954 | Hacker | 52/82 |
| 2,881,718 | 4/1959 | Stromeyer | 52/83 |
| 3,619,958 | 11/1971 | Viesi | 52/83 |
| 3,667,173 | 6/1972 | Billgren | 52/83 |
| 3,807,421 | 4/1974 | Geiger | 52/63 |
| 3,886,961 | 6/1975 | Geiger | 52/63 |

FOREIGN PATENT DOCUMENTS

| | | | |
|---|---|---|---|
| 214190 | 3/1958 | Australia | 52/83 |
| 59386 | 12/1967 | German Democratic Rep. | 52/83 |
| 41773 | 3/1962 | Poland | 52/82 |
| 428341 | 4/1935 | United Kingdom | 52/82 |

OTHER PUBLICATIONS

Raumliche Tragwerke aus Stahl by Makowski pp. 200–203 1964.

Engineering News Record Aug. 26, 1959, p. 45.

*Primary Examiner*—John E. Murtagh

*Attorney, Agent, or Firm*—Ronald C. Hudgens; Ted C. Gillespie; Paul J. Rose

[57] ABSTRACT

The fabric roof structure comprises a pair of vertically spaced upper and lower peripheral compression rings, a central tension ring, a plurality of tensioned upper and lower cables extending radially of the rings, being connected adjacent inner ends to the central tension ring, and being connected adjacent outer ends alternately respectively to the upper and lower peripheral compression rings, and roofing fabric associated with the cables and rings and covering the area from the central tension ring outwardly to the peripheral compression rings.

9 Claims, 9 Drawing Figures

FABRIC ROOF STRUCTURE

TECHNICAL FIELD

This invention relates generally to fabric roofs, and more particularly to fabric roofs supported by tensioned cables.

BACKGROUND ART

Plastic coated glass fiber fabric roofs are being used with increasing frequency as an attractive alternative to traditional roof structures, particularly when large areas are to be covered. Lower weight, lower initial costs, less construction time, lower lighting and air conditioning costs, less maintenance, and full utilization of space are some of the advantages. One of the earliest and perhaps the most famous use of a fabric roof structure in the United States is on the Silverdome stadium at Pontiac, Mich. The Silverdome roof is an air supported structure, with air pressure inside the stadium maintained about 0.25 percent above atmospheric pressure. Such a facility requires built-in air locks and a full-time maintenance staff. When a facility is largely unattended or not monitored, or when air locks cannot be easily designed thereinto, or when free and open access thereto is desired, then a fabric roof supported by structural arches or by tensioned cables is suitable. The present invention relates to a fabric roof supported by tensioned cables.

DISCLOSURE OF INVENTION

In accordance with the invention, a circular fabric roof structure is provided which includes a pair of vertically spaced upper and lower peripheral compression rings, a central tension ring, a plurality of tensioned upper and lower cables extending radially of the rings, connected adjacent inner ends to the central tension ring, and connected adjacent outer ends alternately respectively to the upper and lower peripheral compression rings, and roofing fabric associated with said cables and rings and covering the area from the tension ring outwardly to the compression rings.

BRIEF DESCRIPTION OF THE DRAWINGS

The invention is hereinafter more fully described with reference to the accompanying drawings wherein.

BEST MODE OF CARRYING OUT THE INVENTION

Figure 2:
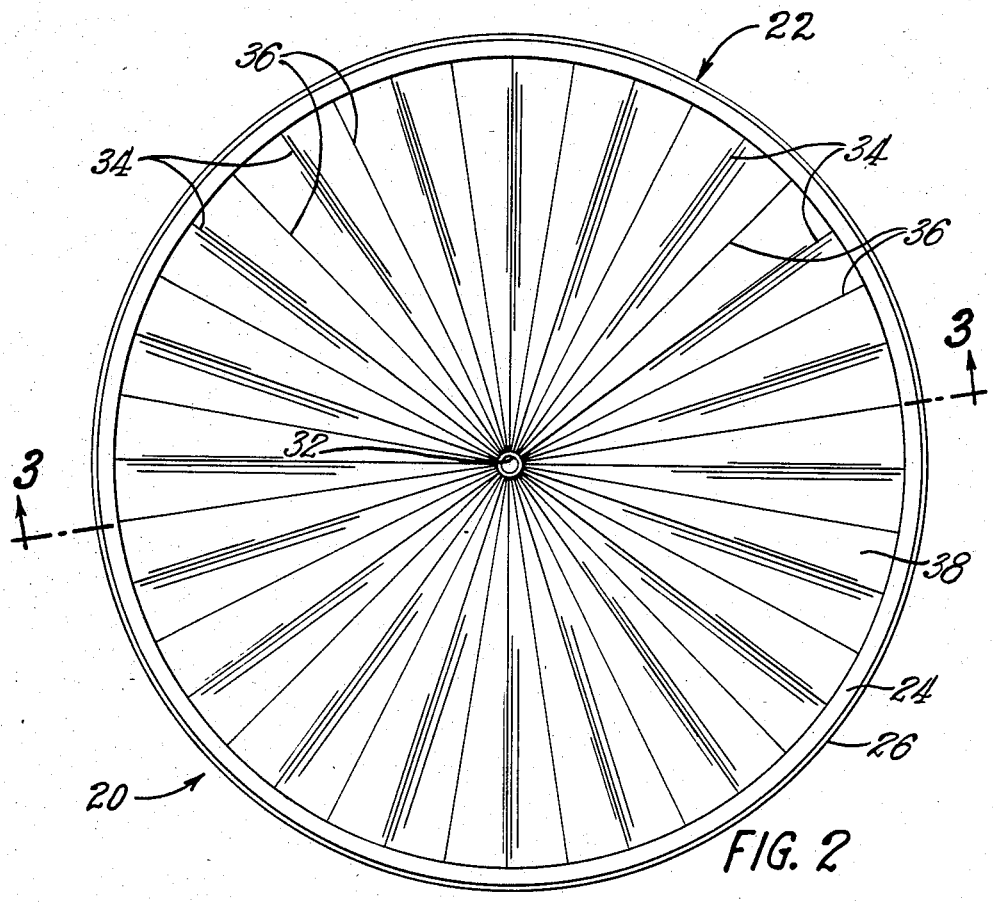
FIG. 2 is a plan view of the structure of FIG. 1.
Figure 1:
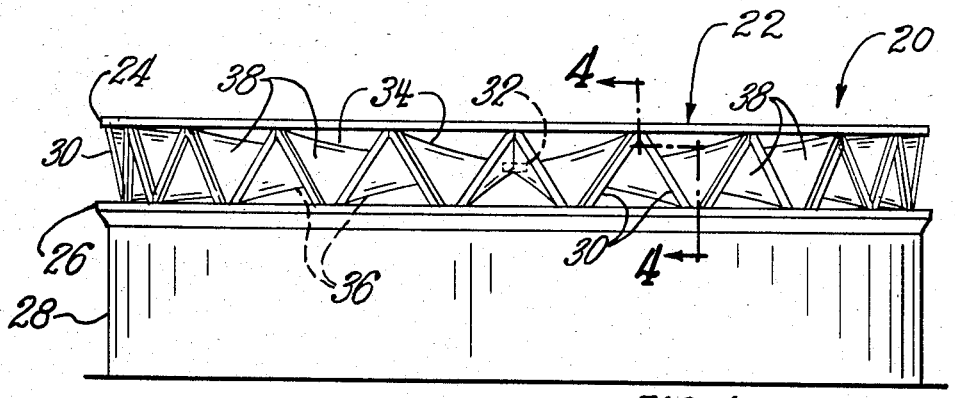
FIG. 1 is an elevational view of a circular enclosure or building having a fabric roof structure constructed in accordance with the invention.

With reference to the drawings, FIGS. 1 and 2 show a circular enclosure or building 20 having a fabric roof structure 22 constructed in accordance with the invention. The roof structure 22 includes an upper peripheral compression ring 24 and a lower peripheral compression ring 26 made of concrete. The lower ring 26 is supported by wall 28 of the building 20. Struts 30, also made of concrete and extending generally at forty-five degree angles to the rings 24 and 26, support the upper ring 24. A central tension ring 32 made of metal is supported by a plurality of tensioned upper cables 34 and lower cables 36 equally arcuately spaced and anchored at their outer ends alternately in the upper ring 24 and in the lower ring 26. Plastic coated translucent glass fiber fabric 38 associated with the cables and clamped to the struts 30 and to the central ring 32 forms the covering of the roof structure 22.

Figure 3:
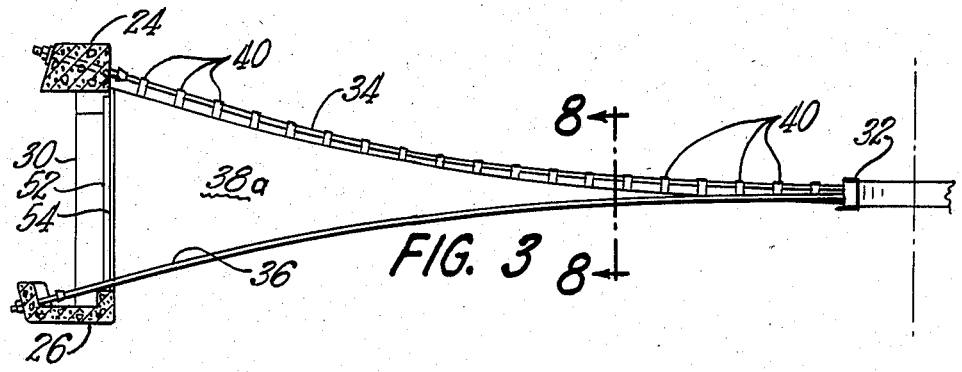
FIG. 3 is an enlarged fragmentary sectional view taken generally along the line 3—3 of FIG. 2.
Figure 4:
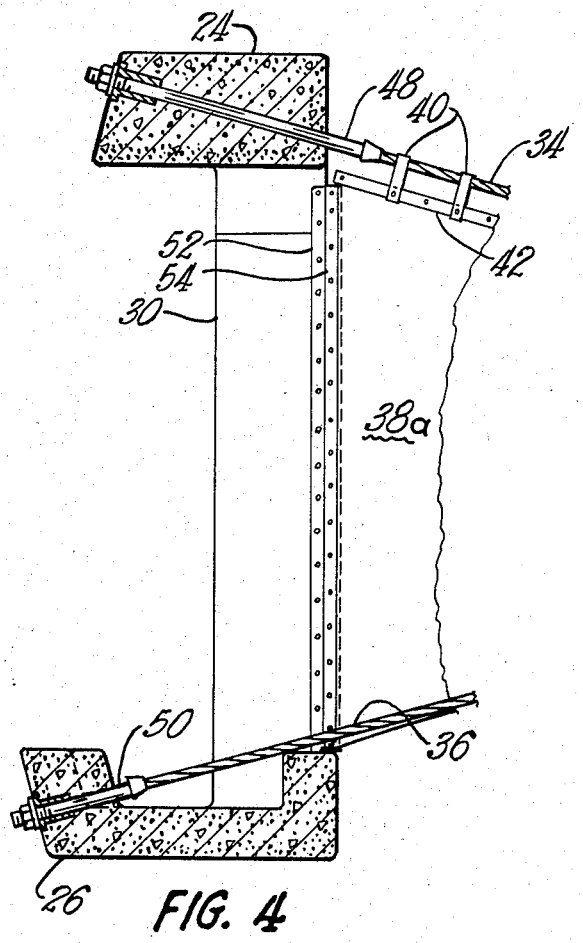
FIG. 4 is an enlarged fragmentary offset sectional view taken generally along the line 4—4 of FIG. 1.
Figure 8:
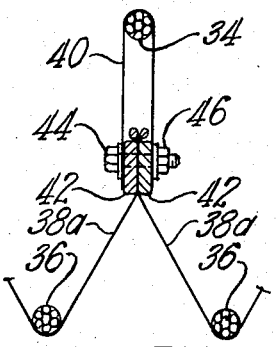
FIG. 8 is a cross-sectional view taken generally along the line 8—8 of FIG. 3.

In an embodiment of the invention shown in FIGS. 3, 4, and 8, each of the upper cables 34 has a plurality of inverted generally U-shaped suspension straps 40 hung thereover and spaced longitudinally therealong. The straps 40 suspend a pair of clamping members 42 held together by a plurality of bolts 44 and nuts 46 and clamping beaded edge portions of a pair of generally triangular fabric segments **38*a*. Each fabric segment 38*a* has two radial edges clamped respectively along two adjacent upper cables 34 and a central portion held down by a lower cable 36. Each upper cable 34 is connected at an outer end to a suitable anchor 48 secured in the upper compression ring 24 and each lower cable 36 is connected at an outer end to a suitable anchor 50 secured in the lower compression ring 26**.

Figure 7:
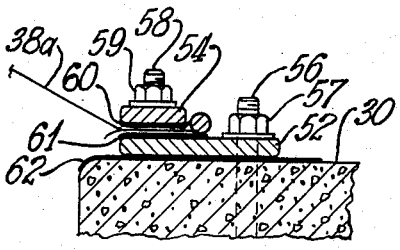
FIG. 7 is a cross-sectional view through one of the struts of the fabric roof structure of FIG. 1 and associated clamping plates.

At an inner edge portion on its upper inclined surface, each strut 30 is provided with a pair of clamps including a relatively wide lower clamp 52 and a relatively narrow upper clamp 54 in an arrangement best shown in FIG. 7. The lower clamp 52 is secured to the strut 30 by a plurality of concrete anchor bolts 56 with nuts 57 screwed thereon. Studs 58 secured in the clamp 52 have nuts 59 screwed thereon to clamp a beaded edge portion of the fabric segment **38*a* between the clamps 52 and 54. Neoprene gaskets 60, 61, and 62 are provided respectively between the clamp 54 and the fabric segment 38*a*, between the fabric segment 38*a* and the clamp 52, and between the clamp 52 and the strut 30**.

Figure 5:
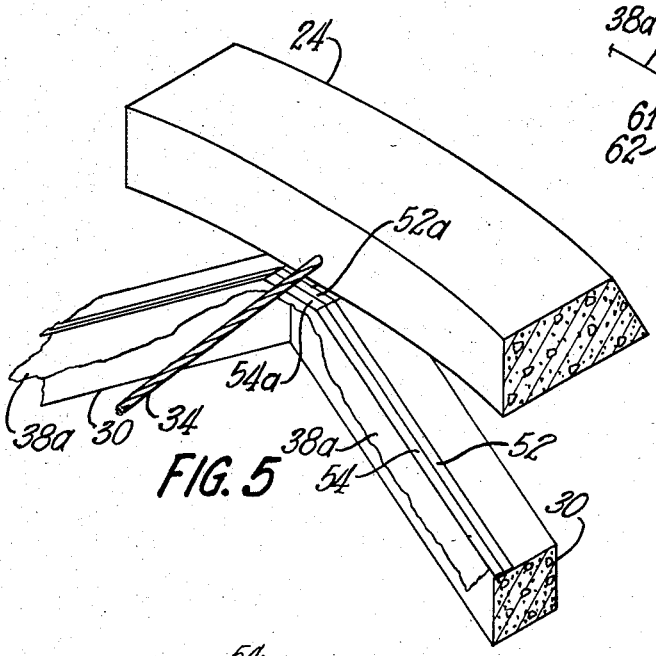
FIG. 5 is a fragmentary perspective view of an upper compression ring of the fabric roof structure of FIG. 1 and associated struts.
Figure 6:
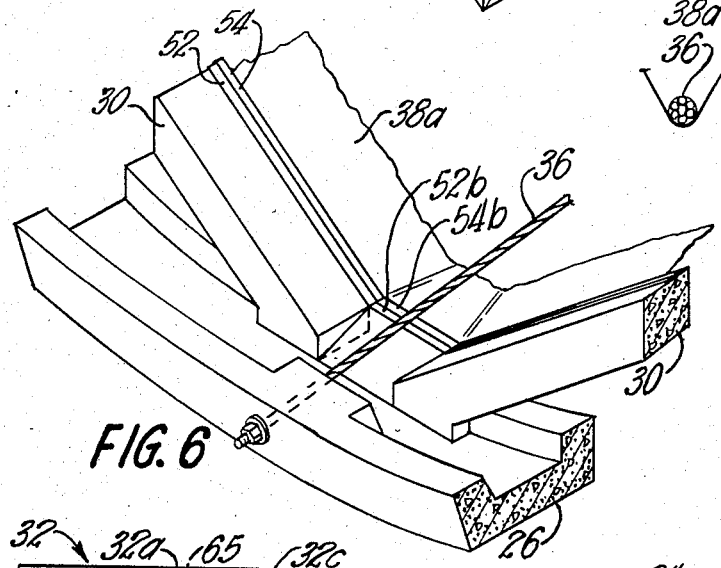
FIG. 6 is a fragmentary perspective view of a lower compression ring of the fabric roof structure of FIG. 1 and associated struts.

As shown in FIG. 5, a similar arrangement of clamps **52*a* and 54*a* is provided across horizontal upper surfaces of adjacent struts 30, and as shown in FIG. 6, a similar arrangement of clamps 52*b* and 54*b* is provided on the lower compression ring between the lower portions of each pair of adjacent struts 30**.

Figure 9:
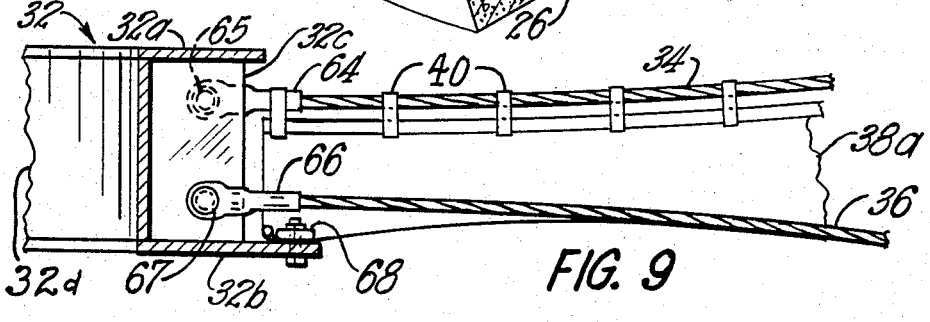
FIG. 9 is a fragmentary cross-sectional view of a central tension ring of the fabric roof structure of FIG. 1.

FIG. 9 fragmentarily shows the central tension ring 32 including an annular upper plate **32*a*, an annular lower plate 32*b* of about the same inner diameter but having a larger outer diameter than the plate 32*a*, and a plurality of radially and vertically extending rectangular plates 32*c* connecting the plates 32*a* and 32*b*. The ring 32 may also include a tubular member 32*d* joined to the upper and lower plates 32*a* and 32*b* adjacent their inner peripheries. Each upper cable 34 is provided on an inner end with a forked connector 64 and each lower cable 36 is provided on an inner end with a forked connector 66. The connectors 64 and 66 may be open spelter sockets or open swage sockets and are connected alternately to the plates 32***c*, the connectors 64 being connected to upper portions of a first set of alternate plates 32*c* by pins 65 and the connectors 66 being connected to lower portions of a second set of alternate plates 32*c* by pins 67. Inner beaded end portions of fabric segments 38*a* are suitably clamped to the lower plate 32*b* by a plurality of clamping members 68 secured to and disposed in an annular arrangement around the lower plate 32*b*.

The clamping members 42, 52, and 54 may be segmented. The fabric segments 38*a* may be larger or smaller than as illustrated and may have edges secured to the lower cables 36 in the same manner shown for securing edges to the upper cables 34 and further may have intermediate portions wrapped around upper portions of cables 34 in the same manner intermediate portions are wrapped around lower portions of the cables 36.

Various other modifications may be made in the structure shown and described without departing from the spirit and scope of the invention.

I claim:

1. A fabric roof structure comprising a pair of vertically spaced upper and lower peripheral compression rings, a plurality of alternately oppositely angularly extending struts disposed between the compression rings and supporting the upper compression ring, a central tension ring, a plurality of tensioned upper and lower cables extending radially of the rings, being connected adjacent inner ends to the central tension ring, and being connected adjacent outer ends alternately respectively to the upper and lower compression rings, each upper cable being connected to the upper compression ring generally between upper end portions of two upwardly convergent struts and each lower cable being connected to the lower compression ring generally between two downwardly convergent struts, a plurality of clamping means respectively secured to and extending longitudinally along the struts, a plurality of clamping members secured to and disposed in an annular arrangement around the central tension ring, a plurality of clamping means respectively secured to and extending longitudinally along at least some of the cables, and roofing fabric segments associated with the cables and rings and collectively covering the area from the central tension ring outwardly to the compression rings, each roofing fabric segment having an inner end portion clamped by at least one of the clamping members on the central tension ring, an outer edge portion clamped by the clamping means on at least one of the struts, and a pair of radial edge portions clamped respectively by the clamping means on a pair of the cables.

2. A fabric roof structure as claimed in claim 1 wherein the compression rings are formed of concrete.

3. A fabric roof structure as claimed in claim 1 wherein the central tension ring is formed of metal.

4. A fabric roof structure as claimed in claim 1 wherein the struts are formed of concrete.

5. A fabric roof structure as claimed in claim 1 wherein the clamping means on the cables are respectively on and only on all of the upper cables and wherein each roofing fabric segment has its opposed radial edge portions clamped respectively by the clamping means on a pair of adjacent upper cables and has an intermediate portion passing under the lower cable between the pair of adjacent cables.

6. A fabric roof structure as claimed in claim 1 wherein the central tension ring is disposed between the upper and lower compression rings in a vertical direction, whereby the upper cables are inclined generally upwardly from the central tension ring to the upper compression ring and the lower cables are inclined generally downwardly from the central tension ring to the lower compression ring.

7. A fabric roof structure as claimed in claim 6 wherein the clamping means on the cables are respectively on and only on all of the upper cables, wherein each roofing fabric segment has its opposed radial edge portions clamped respectively by the clamping means on a pair of adjacent upper cables and has an intermediate portion passing under the lower cable between the pair of adjacent upper cables, and wherein the outwardly downward inclination of the lower cable imparts an outwardly downward inclination to the intermediate portion of the fabric segment for the run-off of rain toward the lower compression ring.

8. A central composite tension ring assembly for a fabric roof structure wherein roofing fabric is supported by tensioned cables, the assembly comprising a ring having an annular upper plate, an annular lower plate of about the same inner diameter but having a larger outer diameter than the upper plate, and a plurality of radially and vertically extending generally rectangular plates connecting the upper and lower plates and adapted to serve as anchoring means respectively for the cables, and a plurality of clamping members disposed in an annular arrangement about and cooperable with an outer peripheral portion of the lower plate in the clamping of roofing fabric.

9. A central tension ring assembly as claimed in claim 8 including a tubular member joined to the upper and lower plates adjacent their inner peripheries.

* * * * *